US012467460B1

(12) United States Patent
Balconi et al.

(10) Patent No.: US 12,467,460 B1
(45) **Date of Patent: *Nov. 11, 2025**

(54) COMPENSATION ASSEMBLIES FOR FLUID HANDLING DEVICES AND RELATED DEVICES, SYSTEMS, AND METHODS

(71) Applicant: FLOWSERVE PTE. LTD., Singapore (SG)

(72) Inventors: Davide Balconi, Renate (IT); Marc van Dongen, Breda (NL)

(73) Assignee: Flowserve Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 18/902,751

(22) Filed: Sep. 30, 2024

Related U.S. Application Data

(63) Continuation of application No. 18/375,428, filed on Sep. 29, 2023, now Pat. No. 12,123,416, which is a continuation of application No. 17/069,645, filed on Oct. 13, 2020, now Pat. No. 11,788,532.

(30) Foreign Application Priority Data

Jul. 14, 2020 (IT) ..... 102020000017095

(51) Int. Cl.
*F04D 1/06* (2006.01)
*F04D 29/42* (2006.01)
*F04D 29/62* (2006.01)

(52) U.S. Cl.
CPC ..... *F04D 1/06* (2013.01); *F04D 29/426* (2013.01); *F04D 29/628* (2013.01)

(58) Field of Classification Search
CPC . F04D 1/06; F04D 1/063; F04D 1/066; F04D 17/12; F04D 17/122; F04D 29/426; F04D 29/445; F04D 2260/38
See application file for complete search history.

(56) References Cited

U.S. PATENT DOCUMENTS

| | | | |
|---|---|---|---|
| 3,801,217 | A | 4/1974 | Ryall |
| 4,098,558 | A | 7/1978 | Bush |
| 4,113,089 | A | 9/1978 | Bush |
| 4,579,509 | A | 4/1986 | Jacobi |
| 4,872,808 | A | 10/1989 | Wilson |
| 6,471,468 | B1 | 10/2002 | Hartmann |
| 8,807,915 | B2 | 8/2014 | Moritsugu |
| 9,803,644 | B2 | 10/2017 | Bergamini |
| 2016/0305447 | A1 | 10/2016 | Dreiss |
| 2020/0067376 | A1 | 2/2020 | Judge |

FOREIGN PATENT DOCUMENTS

| | | |
|---|---|---|
| CN | 202250886 | 5/2012 |
| CN | 108050054 A | 5/2018 |
| WO | 2014086730 A1 | 6/2014 |
| WO | 2019049398 A1 | 3/2019 |

OTHER PUBLICATIONS

GSG Diffuser Style Barrel Pump—5 pages—Nov. 2015.
Oil and Gas Barrel Pumps—16 pages—Oct. 2019.
Search Report and Written Opinion—8 pages—dated Mar. 10, 2021.

*Primary Examiner* — Justin D Seabe
(74) *Attorney, Agent, or Firm* — BKRIP LLC

(57) ABSTRACT

Pumps and fluid-handling devices for modifying at least one property of a fluid and related method comprise a compensation element including at least one biasing element to enable a hydraulic insert to move within a housing.

20 Claims, 5 Drawing Sheets

COMPENSATION ASSEMBLIES FOR FLUID HANDLING DEVICES AND RELATED DEVICES, SYSTEMS, AND METHODS

CROSS-REFERENCE TO RELATED APPLICATION

This application is a continuation of U.S. patent application Ser. No. 18/375,428, filed Sep. 29, 2023, which application is a continuation of U.S. patent application Ser. No. 17/069,645, filed Oct. 13, 2020, which application claims the benefit under 35 U.S.C. § 119 (a) of Italian Patent Application No. 102020000017095, filed Jul. 14, 2020, for "COMPENSATION ASSEMBLIES FOR FLUID HANDLING DEVICES AND RELATED DEVICES, SYSTEMS, AND METHODS," the disclosure of each of which is hereby incorporated herein in its entirety by this reference.

TECHNICAL FIELD

The present disclosure relates generally to compensation assemblies for fluid handling devices. More particularly, embodiments of the present disclosure relate to compensation assemblies for biasing internal components of fluid handling devices, such as pumps and related devices, systems, and methods.

BACKGROUND

Industrial processes often involve hydraulic systems including pumps, valves, impellers, etc. Pumps and valves may be used to control the flow of the fluids used in the hydraulic processes. For example, some pumps may be used to increase (e.g., boost) the pressure in the hydraulic system, while other pumps may be used to move the fluids from one location to another.

Pump F impellers and diffusers are well-known components that cooperate with one another in rotating turbomachinery to impart energy to a working fluid. In one conventional pump design, the impeller (e.g., a rotor) rotates to increase the kinetic energy of the fluid, while the diffuser or housing (e.g., often in the form of an array of vanes) remains stationary and radially outward of the impeller to convert the kinetic energy into pressure energy. The torque required to drive the rotor is generally provided by a motor and transmitted through a rotating shaft to the rotor that rotates within a pump housing. Similarly, in the case of a conventional turbine design, fluid flow and pressure are applied to a rotor, causing the rotor to rotate inside of a stationary turbine casing, and the rotation and torque generated by the rotor are transmitted through a rotating shaft to an external generator.

One of the difficulties relating to pumps or turbines is the ability to scale up the capacity of an existing pump or turbine design to meet the requirements of a given application, which generally requires redesigning the physical shape and size of the rotor, operating the rotor at a higher speed, and/or adding additional rotors.

The total head that is generated by a pump is a function of the rotor diameter and its rotation speed, while the flow delivery for a given rotor diameter and speed is determined by the rotor width. For a given rotor design, the maximum rotor speed is limited by the amount of torque that the motor can develop. The speed of rotation is also limited by both the frequency limitations of the inverter used to drive the motor and the net positive suction head (NPSH) available at the inlet of the rotor.

Increasing output by expanding the number of rotors can also be problematic for any pump or turbine design. For example, in a multistage pump or turbine, a single, large motor provides torque to a plurality of rotors through a common shaft, or a single, large generator receives torque from a plurality of rotors through a common shaft. This approach typically requires a large and bulky motor or generator, and further requires that the shaft must be enlarged in diameter and increased in length as the number of rotor stages is increased, so that the combined torque and weight of all of the rotors can be accommodated. Minimizing the shaft length (e.g., the distance between the two supporting bearings) has the advantage to guarantee the correct shaft rigidity, in order to avoid rotodynamic problems to the pump.

Further, due to the intrinsic functional characteristics of each impeller stage, the generated hydraulic pressure generates an axial thrust at each individual impeller. The sum of all individual thrust loads determined by each individual impeller may become quite significant and require the use of a balancing device (e.g., a balancing drum) that generates an opposed thrust load able to substantially equalize the concurrent thrust loads to enable the normal operation of the pump.

BRIEF SUMMARY

Various embodiments may include a pump for modifying at least one property of a fluid. The pump may include an outer housing and pump stages positioned in the outer housing. Each pump stage of the pump stages may include an impeller and a diffuser at least partially housing the impeller. The pump may further include a shaft positioned in the outer housing, the impeller of each of the pump stages being coupled to the shaft, where the shaft is to rotate each impeller about an axis of the shaft to modify the at least one property of the fluid as the fluid travels through each of the pump stages. The pump may further include a crossover element positioned between a first set of the pump stages and a second set of the pump stages, where the crossover element is to enable fluid communication between the first set of the pump stages and the second set of the pump stages. The pump may further include a compensation assembly positioned in the outer housing and comprising at least one biasing element to bias the compensation assembly into an initial position, where the compensation assembly is to enable the second set of the pump stages to move against a biasing force of the at least one biasing element within the outer housing in an axial direction along the axis of the shaft relative to at least one of the first set of the pump stages or the crossover element.

Another embodiment may include a fluid-handling device for modifying at least one property of a fluid including an outer housing and a first hydraulic insert positioned in the outer housing, where the first hydraulic insert is to modify the at least one property of the fluid as the fluid travels through one or more stages of the first hydraulic insert. The fluid-handling device may further include a second hydraulic insert positioned in the outer housing in fluid communication with the first hydraulic insert, where the second hydraulic insert is to modify the at least one property of the fluid as the fluid travels through one or more additional stages of the second hydraulic insert. The fluid-handling device may further include a crossover element positioned between the first hydraulic insert and the second hydraulic insert, where the crossover element is to enable fluid communication between the first hydraulic insert and the second hydraulic insert. The fluid-handling device may further include a compensation assembly positioned in the outer housing and comprising one or more biasing elements, where the compensation assembly is to enable the second hydraulic insert to move within the outer housing in an axial direction relative to the outer housing in response to a force applied to the second hydraulic insert that is sufficient to overcome a biasing force of the one or more biasing elements.

Another embodiment may include a method of preloading at least one hydraulic insert in a pump including positioning the at least one hydraulic insert within an outer housing of the pump; forcing the at least one hydraulic insert into a crossover element in the outer housing to preload at least one biasing element of a compensation assembly in the outer housing, the crossover element to enable fluid flow between the at least one hydraulic insert and another portion of the pump; and enclosing the at least one hydraulic insert in the outer housing with the at least one biasing element of the compensation assembly in a preloaded condition.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
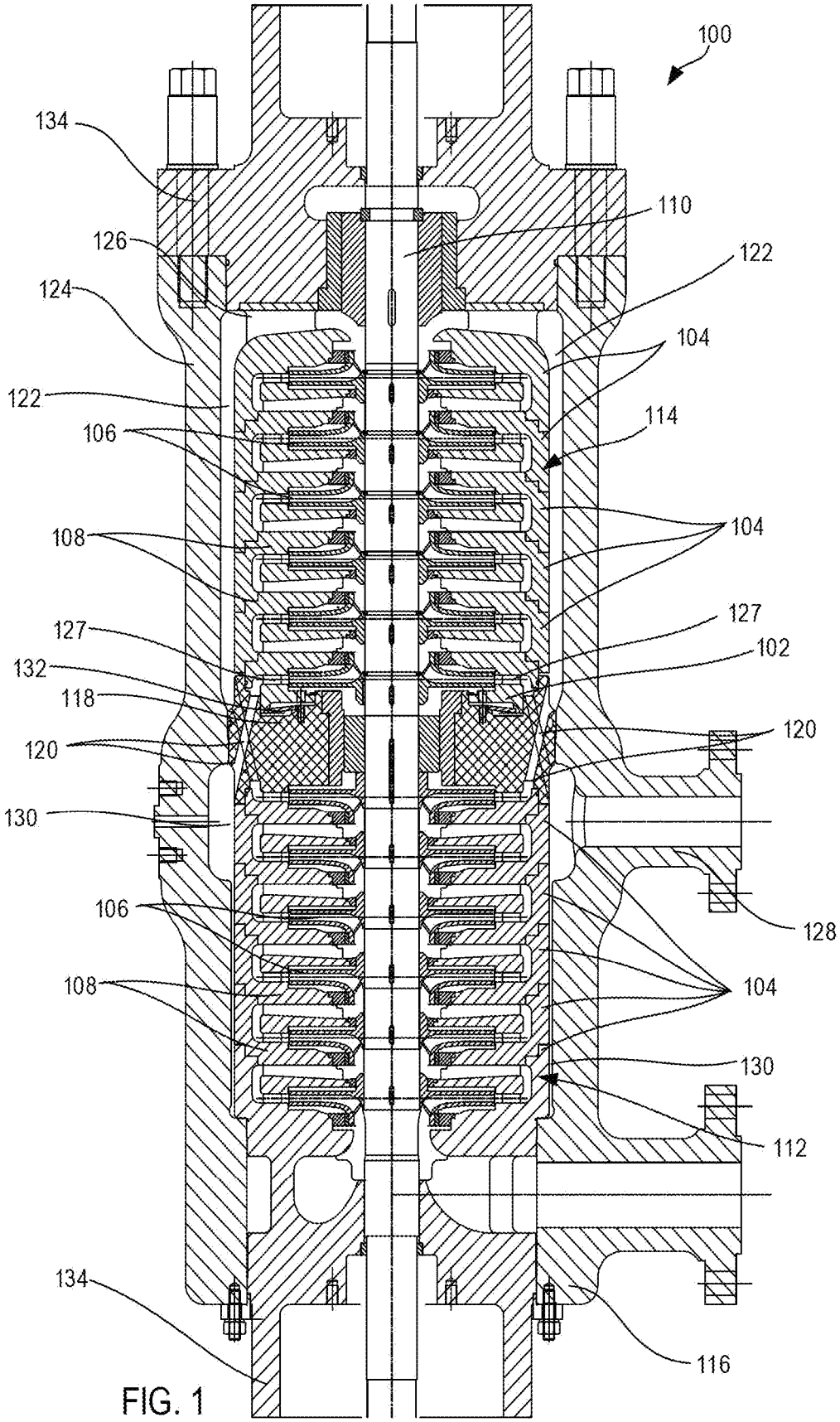
FIG. 1 is a cross-sectional view of a pump including a compensation assembly according to an embodiment of the present disclosure.

The illustrations presented herein are not meant to be actual views of any particular fluid exchanger or component thereof, but are merely idealized representations employed to describe illustrative embodiments. The drawings are not necessarily to scale. Elements common between figures may retain the same numerical designation.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "substantially" or "about" in reference to a given parameter means and includes to a degree that one skilled in the art would understand that the given parameter, property, or condition is met with a small degree of variance, such as within acceptable manufacturing tolerances. For example, a parameter that is substantially met may be at least 90% met, at least 95% met, at least 99% met, or even 100% met.

As used herein, the term "fluid" may mean and include fluids of any type and composition. Fluids may take a liquid form, a gaseous form, or combinations thereof, and, in some instances, may include some solid material. In some embodiments, fluids may convert between a liquid form and a gaseous form during a cooling or heating process as described herein. In some embodiments, the term fluid includes gases, liquids, and/or pumpable mixtures of liquids and solids.

Compensation assemblies in accordance with embodiments of the present disclosure may provide for compensation of loads and thermal expansion in a fluid handling device, such as a pump or turbine. For example, some embodiments may include an integrated compensation assembly or system that can compensate for thrust loads (e.g., opposed thrust loads in an opposed stages pump design) and may establish an axial preload of the internal components of a hydraulic cartridge (e.g., one or more inserts of stages, each including an impeller).

Embodiments of the present disclosure include pumps, which may also be characterized as turbines. In some embodiments, a multistage pump may include an opposed number of stages, such as that discussed below. Such an imposed multistage pump includes a majority of or all of the pump characteristics of a multistage pump with inline stages, each being commonly aligned. However, the imposed multistage pump may exhibit the advantage of substantially self-balancing the hydraulic thrust loads. The resulting pump design may exhibit a substantially residual overall thrust load and may be relatively more stable and less susceptible to the operational conditions and wear of the internal components. Further, such designs may enable the use of self-lubricated standard thrust bearings, along with significant cost reduction and operational simplifications.

When implemented in an opposed impeller pump, a compensation element or assembly may be installed in the center of the pump (e.g., at or integral with a central element) between the last stage of the hydraulic set and the central element that separates the opposed stages of the pump. In such embodiments, and in order to facilitate the opposed stages in such a pump design, the central element (e.g., a crossover element) may be positioned between the opposed stages to enable crossflow between the two opposite inserts or banks of hydraulic stages. The central element, including a compensation element (e.g., housing the compensation element) in accordance with embodiments of the disclosure, may act to hold or secure a center sleeve that acts as a central hydrodynamic bearing of the shaft driving the rotors of the opposing stages and may align the stages relative the pump housing. The central element, including a compensation element in accordance with embodiments of the disclosure, may further hold or secure a gasket sealing the two different pressures between the two blocks of hydraulic elements, may balance the hydraulic thrust, and may enable compression of the internal elements for the use of various types of closures, such as, for example, bayonet-type closures.

Embodiments of the present disclosure may include an integrated compensation assembly or system at an end stages of the pump. For example, the integrated compensation assembly may be positioned proximate (e.g., at) a central element of the pump, which central element separates one or more sets of stages of the pump (e.g., opposed stages). In some embodiments, the integrated compensation assembly may define at least a portion of a stage diffuser at an end of the set of stages (e.g., the last stage diffuser in the set of stage diffusers). As discussed above, the central element may be a crossover element that enables fluid flow between opposed sets of stages.

The compensation element or assembly may enable one or more stages of the pump to move along on an axial direction of the pump (e.g., along a longitudinal axis, along an axis of rotation of the rotor, etc.). Such movement may axially load the compensation assembly. For example, one or more sets of the pump stages may not be coupled to a pump housing and may only be constrained by portions of the pump housing (e.g., one or more housing end caps) that retain the stages in the pump housing (e.g., the stages may be substantially free-floating within the pump housing). One or more of the sets of stages may be forced into the compensation element to preload the stages while still enabling further axial movement of the stages.

Some embodiments of the compensation assemblies disclosed herein include one or more biasing elements (e.g., spring washers, such as Belleville, crescent, dome, finger, wave, single wave washers, etc.) where the compression amplitude of the one or more biasing elements enables dynamic compensation of thermal dilatations and other variable loads and/or movements of the pump. Such a compensation assembly may permit the use of housing portions (e.g., a pump casing-cover closure) with methods different from the traditional studs and bolts, for example, with a bayonet-type of closure.

While embodiments of the present disclosure discuss a compensation assembly with particular reference to a multistage impeller pump with opposed sets of stages, additional embodiments may be implemented in other types of pumps, turbines, and other fluid-handling devices (e.g., in an inline impeller pump, etc.).

FIG. 1 illustrates a cross-sectional view of a pump 100 including a compensation assembly 102. As depicted, the pump 100 may comprise a multistage pump 100 including one or more stages 104, where each stage 104 includes an impeller 106 (e.g., a rotor) and a diffusor 108 (e.g., a stator, a stage housing, etc.). Each impeller 106 may be coupled to a common shaft 110 that extends along and rotates about an axis of the pump 100 (e.g., a longitudinal axis) and that may be driven by an external and/or internal motor or by another energy source.

In an opposed configuration, each set of adjacent stages 104 may define an insert (e.g., first insert 112 and second insert 114). For example, the first insert 112 may be positioned proximate (e.g., at) a fluid inlet 116. Fluid from the inlet 116 may be provided into the stages 104 where each stage 104 alters at least one property of the fluid (e.g., kinetic energy, pressure, etc.) as it passes through the stage 104. As discussed above, each of the impellers 106 forces the fluid through each respective stage 104 in order to pressurize the fluid.

After passing through the first insert 112, the fluid may pass into a central element (e.g., crossover element 118) that separates the first insert 112 from the second insert 114. As depicted, the crossover element 118 may define a portion of (e.g., one axial side of, a majority of) the diffuser 108 of the last stage 104 of the first insert 112. One or more channels 120 in the crossover element 118 enables the fluid to pass to a volume proximate the second insert 114. For example, the fluid may pass from the crossover element 118 into an annulus 122 defined between the second insert 114 and an outer pump housing 124 in which one or both of the second insert 114 and the first insert 112 are received. The annulus 122 may extend in an axial direction around the stages 104 of the second insert 114 and be in fluid communication with radial channels 126. The radial channels 126 may connect the fluid to an opening in the first stage 104 of the second insert 114 enabling the fluid to be passed through each stage 104 of the second insert 114.

After passing through the final or last stage 104 of the second insert 114, the fluid may pass to outlet 128 of the pump 100. For example, the fluid may exit the last stage 104 and pass back into the crossover element 118 (e.g., through additional channels 120 in the crossover element 118). As above, the crossover element 118 (e.g., and/or a portion of the compensation assembly 102 that is integral with the crossover element 118) may define a portion (e.g., one axial side, a majority, an entirety) of the diffuser 108 of the last stage 104 of the second insert 114. The channels 120 in the crossover element 118 may be in fluid communication with the outlet 128 via another annulus 130 defined between the second insert 114 and the outer pump housing 124.

In some embodiments, and as depicted, a portion of the crossover element 118 may define a portion of one or both of the annulus 122 and the another annulus 130 with the outer pump housing 124.

As depicted, the compensation assembly 102 may be defined as an integral part of one or more elements of the pump 100. For example, the compensation assembly 102 may be positioned on one axial end of the crossover element 118 and may define at least a portion (e.g., a majority, an entirety) of the diffuser 108 of the last stage 104 of the second insert 114. For example, the compensation assembly 102 may define radial channels 127 extending outward from the impeller 106 that connect with the channels 120 of the crossover element 118. In additional embodiments, the compensation assembly 102 may only define a portion of the diffuser 108 (e.g., one axial side or portion thereof) and/or may be coupled to a separate diffuser 108.

As discussed below in greater detail, the compensation assembly 102 may enable movement of one or more of the stages 104 (e.g., the stages 104 of the second insert 114) in an axial direction of the pump 100 (e.g., along the longitudinal axis of the pump 100 and/or along an axis of rotation of the impellers 106 and/or shaft 110). As depicted, the compensation assembly 102 may include an integral diffuser 108. In some embodiments, the compensation assembly 102 may be integrated with each stage 104 of the second insert 114 where the compensation assembly 102 and the second insert 114 may move collectively together as a single unit.

The compensation assembly 102 may include one or more biasing elements 132 that enable the second insert 114 to move relative to another portion of the pump 100 (e.g., the crossover element 118, the first insert 112, and/or the outer pump housing 124), while dampening such movement. In some embodiments, the biasing elements may comprise one or more of spring washers (e.g., Belleville, crescent, dome, finger, wave, single wave washers), springs (e.g., compression springs, plate springs, volute springs), and/or other elastically compressible or otherwise deformable materials, etc.

In some embodiments, the biasing element or elements 132 may bias the second insert 114 in a position away from (e.g., spaced away from) the crossover element 118. Deformation (e.g., elastic deformation, such as compression) of the biasing element 132 may enable the second insert 114 to move relative to (e.g., toward) the crossover element 118. For example, deformation of the biasing element 132 may enable the second insert 114 to move relatively closer to the crossover element 118. Stated in another way, the compensation assembly 102 may move relatively closer to the crossover element 118 in response to a force applied to the second insert 114 that is sufficient to overcome a biasing force of the biasing element 132.

In some embodiments, the compensation assembly 102 may be loaded (e.g., preloaded in an axial direction) when the one or more of the inserts 112, 114 are placed into the outer pump housing 124. For example, the first insert 112, the second insert 114, and the crossover element 118 may be positioned in the outer pump housing 124 (e.g., positioned separately, in one or more groupings, or as an assembled unit). One or more end caps 134 (e.g., at each end of the outer pump housing 124) may be coupled to the outer pump housing 124 in order to secure the first insert 112, the second insert 114, and the crossover element 118 in the outer pump housing 124.

The first insert 112, the second insert 114, and the crossover element 118 may be sized such that the compensation assembly 102 is at least partially preloaded when at least one of the end caps 134 (e.g., the end cap 134 proximate the second insert 114) is secured in the outer pump housing 124. For example, the second insert 114 may be forced in the compensation assembly 102 in order to deform the biasing element 132 (e.g., elastically deform).

As discussed below in greater detail, such an installation preload may be selected to only partially deform the biasing element 132. The compensation assembly 102 may enable further deformation of the biasing element 132 during operation and/or selected operating conditions of the pump 100.

While the end caps 134 are shown as being fastened to the outer housing 124 (e.g., with bolts), in some embodiments, the compensation assembly 102 may enable the use of other closure assemblies. For example, a quick opening closure (e.g., bayonet closure) may be used on one or both of the end caps 134, where the bayonet closure may preload and/or secure the inserts 112, 114 in the outer pump housing 124.

As depicted, one of the end caps 134 (e.g., the end cap 134 proximate the first insert 112) may be inserted within the outer housing 124 and may define at least a portion of the diffuser 108 of one or more of the stages 104.

Figure 2:
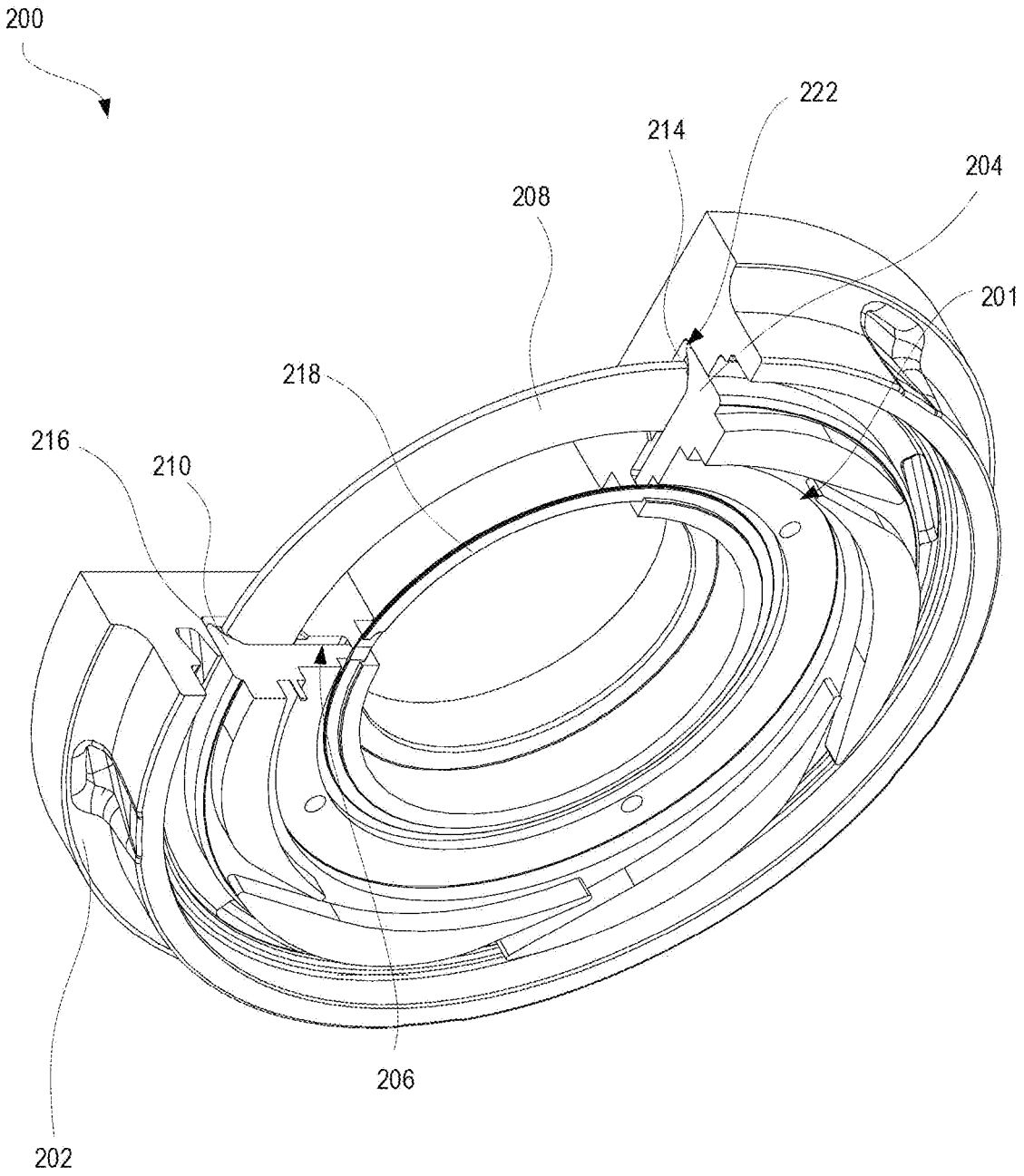
FIG. 2 is a partially cutaway isometric view of a compensation assembly according to an embodiment of the present disclosure.
Figure 3:
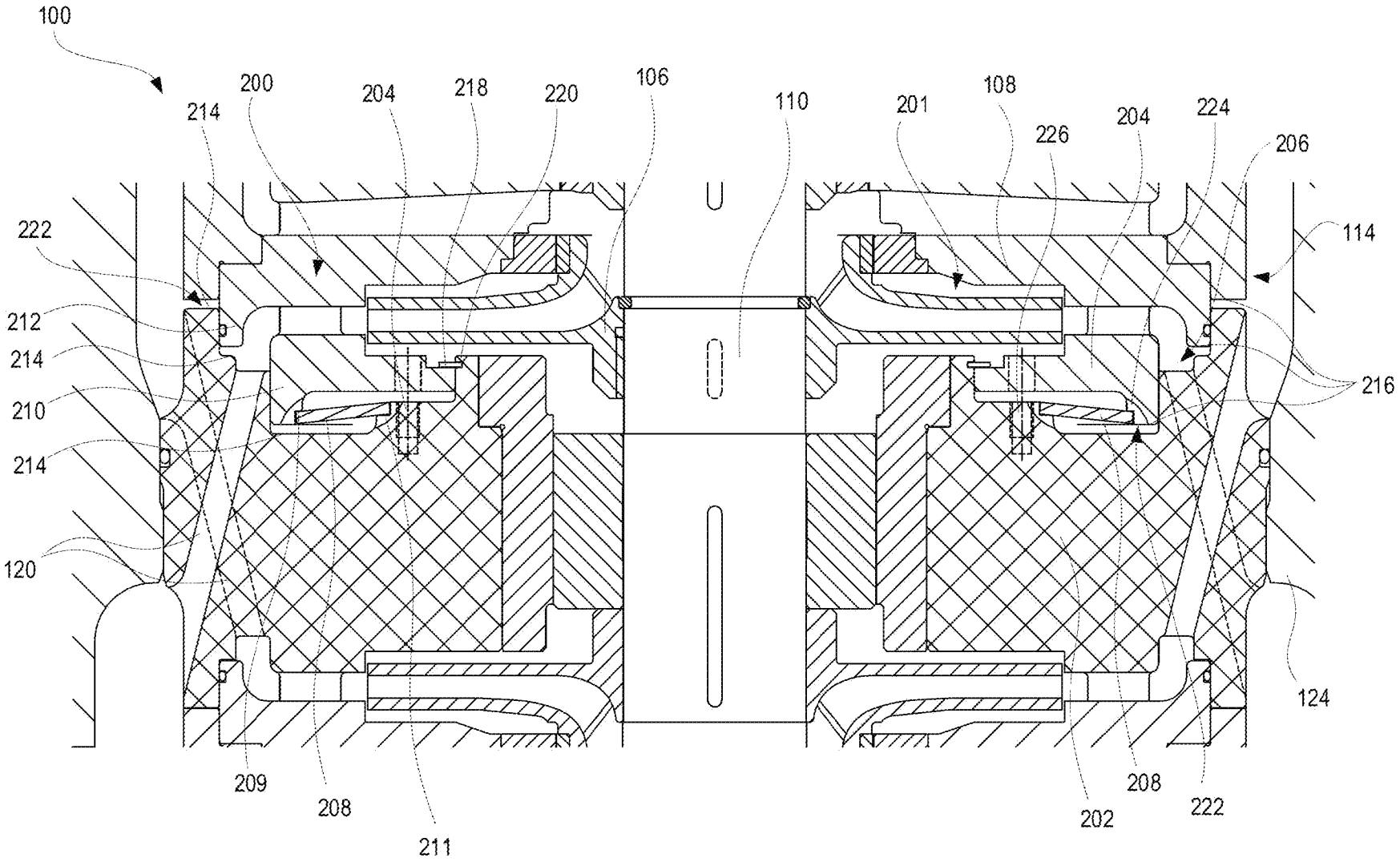
FIG. 3 is a cross-sectional view of a compensation assembly positioned in a pump according to an embodiment of the present disclosure.

FIG. 2 is a partially cutaway isometric view of a compensation assembly 200 and FIG. 3 is a cross-sectional view of the compensation assembly 200 positioned in a pump (e.g., pump 100). In some embodiments, one or both of the compensation assembly 200 and the pump 100, or components thereof, may be similar to, and include the same components of, those discussed above in relation to FIG. 1.

As shown in FIGS. 2 and 3, the compensation assembly 200 is positioned adjacent to a portion of a crossover element 202. For example, the compensation assembly 200 may be at least partially received within a portion of the crossover element 202 and may move relative to the crossover element 202. The compensation assembly 200 and/or the crossover element 202 may be formed as an annular element that extends around the shaft 110 of the pump 100. As above, the compensation assembly 200 may define part, a majority of, or all of one or more diffusers 108 of the pump 100. For example, the compensation assembly 200 may define one or more inner recesses 201 that provide clearance for the impeller 106 (FIG. 1) and define one or more fluid channels for supplying fluid to and/or directing fluid from the impeller 106.

An axial end portion 204 of the compensation assembly 200 may interface with an axial end of the crossover element 202 and may be at least partially received in a recess 206 of the crossover element 202. For example, the axial end portion 204 of the compensation assembly 200 may be received in the recess 206 and may move (e.g., slide, translate) relative to the crossover element 202 (e.g., in an axial direction).

Movement of the axial end portion 204 of the compensation assembly 200 may be constrained in one or more directions. For example, a biasing element 208 (e.g., a spring, a disc washer or spring, a Bellville washer or spring, combinations thereof, etc.) may be positioned between the compensation assembly 200 and the crossover element 202 to enable movement between these elements 200, 202 while also restricting that movement by biasing the compensation assembly 200 away from the crossover element 202. As depicted, the biasing element 208 may be an annular element (e.g., ring) comprising a metal material. In some embodiments, the biasing element 208 may be positioned in a notch or step 209 in the axial end portion 204 of the compensation assembly 200 and a notch or step 211 in the crossover element 202.

The compensation assembly 200 may include a first axial arm or portion 210 that at least partially encompasses the biasing element 208 and a second axial arm or portion 212 that defines a seal between the compensation assembly 200 and crossover element 202 (e.g., with an O-ring). In some embodiments, the first arm 210 and second arm 212 may be radially offset in a stepped configuration and received in a complementary stepped recess 206 of the crossover element 202.

Limits of movement or motion of the compensation assembly 200 may be defined by axially opposing surfaces of the compensation assembly 200 and the crossover element 202. For example, one or more axial surfaces 214 of the crossover element 202 may abut with one or more axial surfaces 216 of the compensation assembly 200 or adjacent stages 104 to prevent movement of the compensation assembly 200 from moving further toward the crossover element 202 in the recess 206 (e.g., moving against the biasing force of the biasing element 208).

On an opposing axial side, another surface (e.g., stop element 218) may prohibit the compensation assembly 200 from moving relatively further away from the crossover element 202 (e.g., by exiting the recess 206). The stop element 218 may comprise a ring seated within a complementary radially extending recess 220 in the crossover element 202. As depicted, movement of the compensation assembly 200 relative to the crossover element 202 may open and close one or more gaps 222 between respective axial surfaces 214, 216 of the compensation assembly 200 and the crossover element 202.

In some embodiments, one or both of the compensation assembly 200 and the crossover element 202 may include one or more features to at least partially (e.g., substantially) balance fluid forces on either axial side of the biasing element 208. For example, one or more scallops 224 may be defined in the compensation assembly 200 that enable fluid in the pump 100 to reach both axial sides of the biasing element 208. The one or more scallops 224 may act to balance forces applied on one side of the biasing element 208 by a fluid with a substantially similar force on an opposing side of the biasing element 208 with the same fluid (e.g., to minimize any pressure differentials).

In some embodiments, the crossover element 202 may be at least partially fixed in (e.g., and sealed to) the outer pump housing 124 (e.g., with complementary stepped radial surfaces) to at least partially (e.g., entirely) prohibit movement of the crossover element 202 within the pump 100. For example, the crossover element 202 may be substantially centered within the outer pump housing 124 with complementary stepped surfaces of the crossover element 202 and the outer pump housing 124.

In some embodiments, one or both of the compensation assembly 200 and the crossover element 202 may include a fastening feature 226, which may be used to secure the compensation assembly 200 to the crossover element 202 in order to preload the biasing element 208. For example, the fastening feature 226 may be used to preload the biasing element 208 in order to condition the biasing element 208 prior to installation in the pump 100 and/or to insert the stop element 218 in its seat, where the fasteners will be removed prior to installation in the pump 100.

Figure 4:
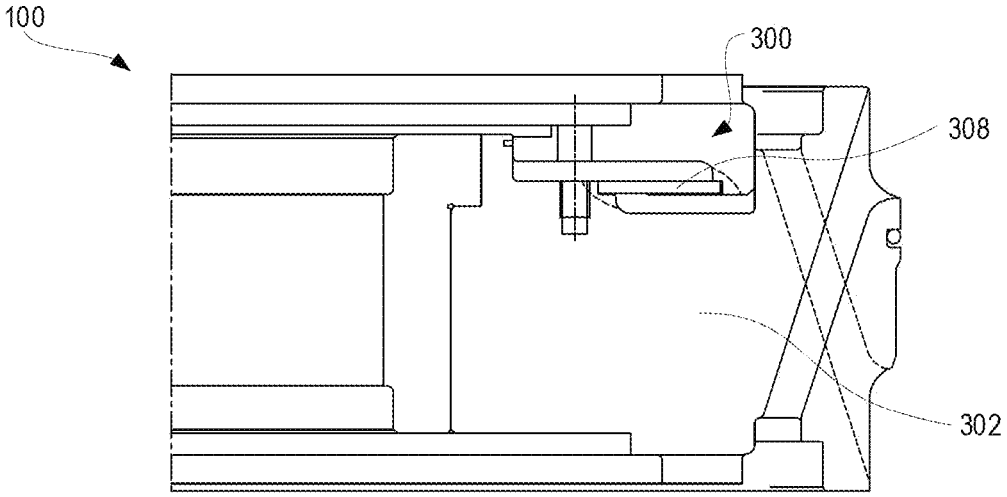
FIG. 4 is a cross-sectional view of a compensation assembly positioned in a pump in a first, unloaded position according to an embodiment of the present disclosure.

FIG. 4 is a cross-sectional view of a compensation assembly 300 positioned in a pump 100 in a first, unloaded position. In some embodiments, one or both of the compensation assembly 300 and the pump 100, or components thereof, may be similar to, and include the same components of, those discussed above in relation to FIGS. 1 through 3. As shown in FIG. 4, biasing element 308 may be in an unloaded (e.g., unstressed) position between the compensation assembly 300 and a crossover element 302.

Figure 5:
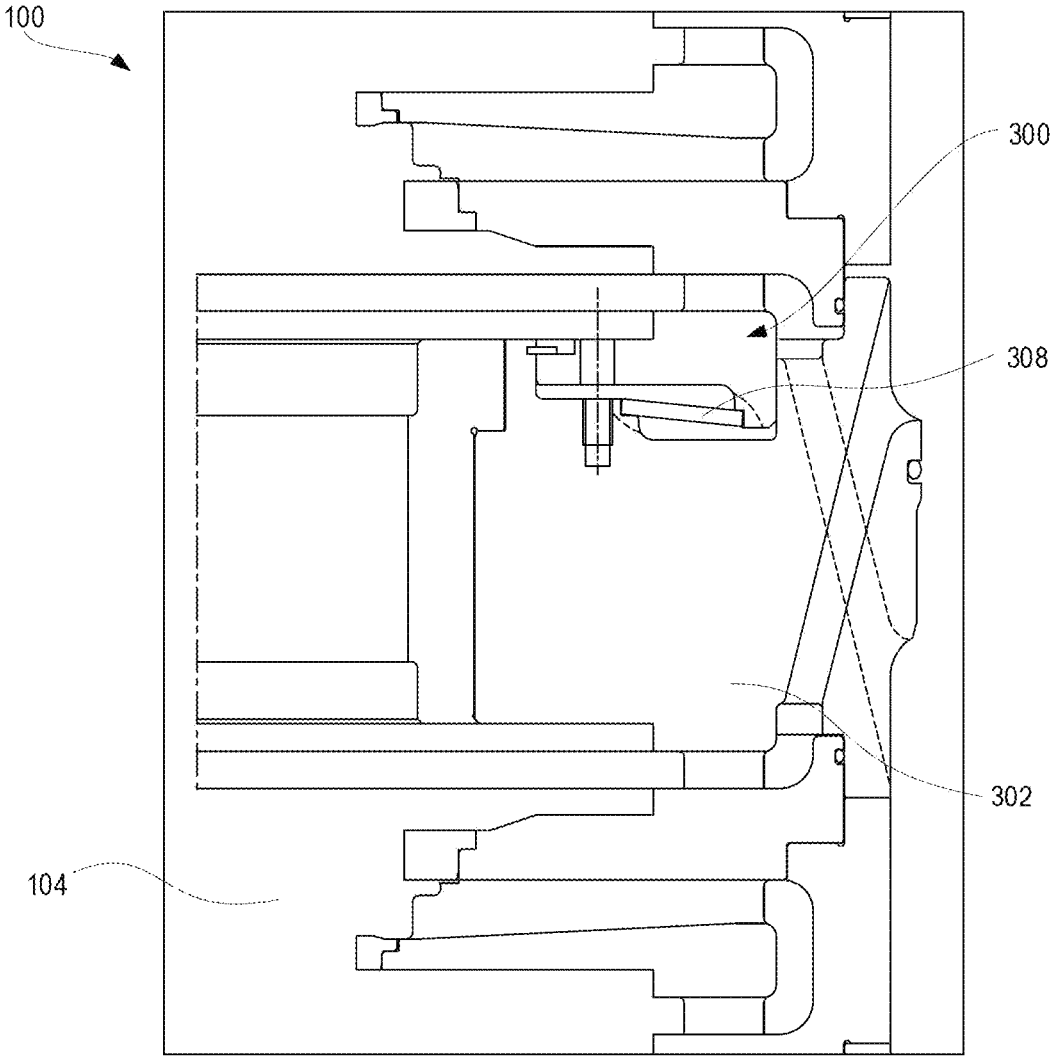
FIG. 5 is a cross-sectional view of a compensation assembly positioned in a pump in a second, partially loaded position according to an embodiment of the present disclosure.

FIG. 5 is a cross-sectional view of the compensation assembly 300 positioned in the pump 100 in a second, partially loaded position. As shown in FIG. 5, the biasing element 308 may be preloaded in a manner similar to that shown in FIG. 3. In some embodiments, the preloading may be a nominal stress condition of the biasing element 308 as it separates the compensation assembly 300 and the crossover element 302. In some embodiments, this preload position may be designed to provide an optimal alignment between portions of the pump 100 (e.g., between the stages 104) to, for example, minimize or even prevent fluid leakage.

Figure 6:
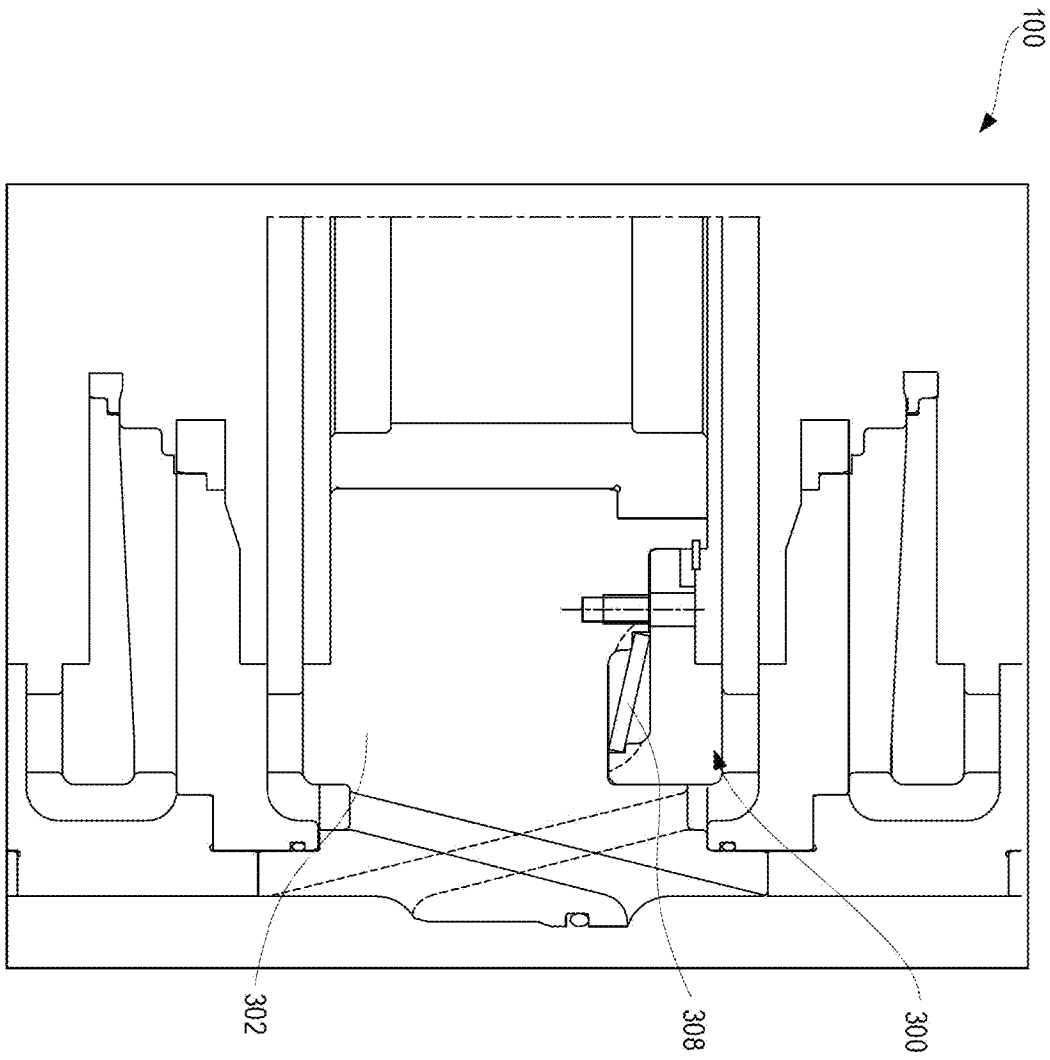
FIG. 6 is a cross-sectional view of a compensation assembly positioned in a pump in a third, maximally loaded position according to an embodiment of the present disclosure.

FIG. 6 is a cross-sectional view of the compensation assembly 300 positioned in the pump 100 in a third, maximally loaded position. As shown in FIG. 6, the biasing element 308 may be at a maximum deflection position. For example, one or more sets of opposing axial surfaces of the compensation assembly 300 and the crossover element 302 may be in contact in order to prevent any further movement of the compensation assembly 300 and/or any further deflection of the biasing element 308. In such an embodiment, any additional axial load will be directly absorbed by the contacting surfaces of the compensation assembly 300 and the crossover element 302, and then rigidly transmitted to the pump housing 124 and/or the end caps 134 (FIG. 1). Such a configuration may at least partially or entirely prevent overloading of the biasing element 308.

As discussed above, embodiments of the present disclosure may provide for compensation of loads and thermal expansion in a fluid handling device, such as a pump or turbine. For example, some embodiments may include an integrated compensation assembly or system that can compensate for thrust loads (e.g., in an opposed stages pump design) and may establish an axial preload of the internal components of a hydraulic cartridge (e.g., sets of stages). Such an integrated compensation system may function to keep the hydraulic cartridge of stages in the pump in functional equilibrium in a majority of or even all operating conditions, as the biasing element acts to bias the stages in a selected, optimal position along an axial direction of the pump. The compensation assembly may also enable optimal alignment and simplified mounting or installing of the internal components of the pump that constitute the hydraulic cartridge.

Pumps or fluid-handling devices in accordance to embodiments disclosed herein may be relatively more capable of withstanding relatively high internal generated pressures, avoid internal fluid leakages, as well as leakage of liquid outside of the pump, and withstand load cycles and thermal dilatations and/or shock at different operating temperature conditions. Further, compensation assemblies in accordance with embodiments of the present disclosure may assist in accounting for the stack-up of machine tolerances in the assembly of multiple components (e.g., pump or turbine stages) in order to substantially ensure an assembly that is consistent with the design expectations. For example, some embodiments of the compensation assemblies disclosed herein may enable compression and decompression of a stack of rotors to the internal thrust loads, the thermal dilatation, and/or the manufacturing machining tolerance stack up variability of the pump.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventors.

What is claimed is:

1. A crossover assembly for use with a fluid-handling device comprising:

a body portion having channels defined therethrough to enable fluid communication between hydraulic inserts of the fluid-handling device; and a compensation element comprising an axial end portion and at least one biasing element, the compensation element positioned only on one side of the body portion with the axial end portion configured to define at least a portion of a diffuser of a last stage of one of the hydraulic inserts, the compensation element secured to the body portion to position and movably secure the at least one biasing element between the compensation element and the body portion prior to being installed in the fluid-handling device, the compensation element to enable a hydraulic insert to move against a biasing force of the at least one biasing element relative to the crossover assembly.

2. The crossover assembly of claim 1, wherein the body portion is configured to be positioned between the hydraulic inserts of the fluid-handling device to enable the fluid communication between the hydraulic inserts.

3. The crossover assembly of claim 1, wherein the at least one biasing element contacts the body portion on only a first side of the at least one biasing element.

4. The crossover assembly of claim 3, wherein the at least one biasing element contacts the compensation element only a second, opposing side of the at least one biasing element.

5. The crossover assembly of claim 1, wherein the at least one biasing element is preloaded by a coupling between the compensation element and the body portion.

6. The crossover assembly of claim 1, further comprising fluid openings defined at an interface between an axial end portion of the compensation element and the at least one biasing element for enabling fluid to travel through the fluid openings and past the at least one biasing element.

7. The crossover assembly of claim 6, wherein both the compensation element and the body portion comprise the fluid openings.

8. The crossover assembly of claim 1, wherein the compensation element further comprises a stop element configured to at least partially prevent the compensation element from being removed from the body portion.

9. The crossover assembly of claim 1, wherein the compensation element defines a diffuser of the hydraulic insert positioned adjacent to the compensation element.

10. A method of preloading at least one hydraulic insert in a fluid-handling device, the method comprising:

positioning at least two hydraulic inserts and a crossover element within a housing of the fluid-handling device, the crossover element comprising a compensation element having at least one biasing element;

separating the at least two hydraulic inserts with the crossover element;

forcing one hydraulic insert of the at least two hydraulic inserts into the compensation element to deform and preload the at least one biasing element;

enclosing the at least two hydraulic inserts and the crossover element in the housing with the at least one biasing element of the compensation element being preloaded and with the at least one biasing element of the compensation element forcing the one hydraulic insert in a direction away from the crossover element; and elastically deforming the at least one biasing element of the compensation element a selected amount by securing an axial end portion of the compensation element to the crossover element.

11. The method of claim 10, further comprising enabling fluid flow through the at least one biasing element of the compensation element with fluid openings defined at an interface between an axial end portion of the compensation element and the at least one biasing element.

12. The method of claim 10, further comprising securing the compensation element to the crossover element with a stop element of the crossover element.

13. A method of preloading at least one hydraulic insert in a fluid-handling device, the method comprising:

positioning at least two hydraulic inserts and a crossover element within a housing of the fluidhandling device, the crossover element comprising a compensation element having at least one biasing element;

separating the at least two hydraulic inserts with the crossover element;

forcing one hydraulic insert of the at least two hydraulic inserts into the compensation element to deform and preload the at least one biasing element;

enclosing the at least two hydraulic inserts and the crossover element in the housing with the at least one biasing element of the compensation element being preloaded and with the at least one biasing element of the compensation element forcing the one hydraulic insert in a direction away from the crossover element; and preloading the at least one biasing element of the compensation element prior to forcing the one hydraulic insert into the compensation element by coupling the compensation element to a body portion of the crossover element.

14. The method of claim 13, further comprising at least partially preventing the compensation element from being removed from a body portion of the crossover element with a stop element of the crossover element, the stop element being positioned between a portion of the crossover element and the compensation element.

15. A fluid-handling device for transporting a fluid, the fluid-handling device comprising:

a housing;

stages positioned in the housing, each stage of the stages comprising a diffuser and an impeller for moving fluid between a fluid inlet of the housing and a fluid outlet of the housing; and a crossover element positioned between a first stage of the stages and a second stage of the stages, the crossover element comprising:

a body portion having channels defined therethrough to enable fluid communication between the diffuser and the impeller of the first stage of the stages and the diffuser and the impeller of the second stage of the stages; and a compensation element comprising at least one preloaded biasing element, the compensation element to enable the second stage of the stages to move against a biasing force of the at least one preloaded biasing element within the housing in an axial direction while the at least one preloaded biasing element forces the second stage in an opposing axial direction, wherein the compensation element further comprises a stop element configured to secure and at least partially prevent the at least one preloaded biasing element from separating the compensation element from the body portion.

16. The fluid-handling device of claim 15, further comprising fluid openings defined at an interface between the crossover element and the at least one preloaded biasing element for enabling fluid to travel through the fluid openings and past the at least one preloaded biasing element.

17. The fluid-handling device of claim 15, wherein both the compensation element and the body portion laterally encompass the at least one preloaded biasing element.

18. The fluid-handling device of claim 15, wherein the compensation element comprises an axial end portion that is secured to the body portion of the crossover element in order to preload the at least one preloaded biasing element.

19. The fluid-handling device of claim 15, wherein the stop element is separate from the stages.

20. The fluid-handling device of claim 15, wherein the at least one preloaded biasing element extends radially between a first point of attachment with the compensation element and a second point of attachment with the body portion.

* * * * *